US005148629A

United States Patent [19]

Minami

[11] Patent Number: 5,148,629

[45] Date of Patent: Sep. 22, 1992

[54] RIGHT-HANDED AND LEFT-HANDED OPENABLE DOOR DEVICE

[75] Inventor: Kangi Minami, Osaka, Japan

[73] Assignee: Osaka Kanagu Co., Ltd., Osaka, Japan

[21] Appl. No.: 699,949

[22] Filed: May 14, 1991

[30] Foreign Application Priority Data

May 14, 1990 [JP] Japan ..... 2-123733

[51] Int. Cl.[5] ..... E05D 7/02

[52] U.S. Cl. ..... 49/193; 16/DIG. 23; 16/232

[58] Field of Search ..... 49/193, 192, 382; 16/231, 232, DIG. 23

[56] References Cited

U.S. PATENT DOCUMENTS

| | | | |
|---|---|---|---|
| 3,889,419 | 6/1975 | Maleck | 49/193 |
| 4,503,582 | 3/1985 | Gurubatham | 49/193 X |
| 4,811,518 | 3/1989 | Ladisa | 49/193 |

*Primary Examiner*—Philip C. Kannan

*Attorney, Agent, or Firm*—Wenderoth, Lind & Ponack

[57] ABSTRACT

A door structure openable from the right side or the left side has hinges at upper and lower positions on both sides of the door main body and door frame for permitting the door to be opened from either the right or the left sides. The hinges each have a shaft carrying member on the door main frame and an L-shaped hinge member having one leg pivotally mounted on the shaft carrying member for pivoting movement about an axis of opening movement of the door, and the other leg having a locking bolt projecting in a direction in which the door main body moves away from the door frame during opening of the door. The locking bolt has a lateral recess. The hinge further has a locking body on the door with a locking bolt receiving recess therein in which the locking bolt is received when the door main body is closed. A spring-loaded locking pin in the recess for normally retaining the locking bolt in the recess and permitting the locking bolt and locking body to be separated by a door opening force.

3 Claims, 4 Drawing Sheets

RIGHT-HANDED AND LEFT-HANDED OPENABLE DOOR DEVICE

BACKGROUND OF THE INVENTION

1. Field of the Invention

This invention relates to a right-handed and left-handed openable door device by which the door of a locker or the like can be opened from the right or left side as desired.

2. Description of the Prior Art

In a locker, a safe or the like, a door is supported on the frame at the left side edge or the right side edge thereof through the medium of hinges and is opened from the right or left side with the hinges as central points.

Since the right-handed or left-handed opening of a door for a locker or the like is determined at the time of manufacture, when purchasing a locker or the like it is necessary to decide whether to purchase a right-handed or left-handed opening of the door in consideration of the place at which the locker is set and the convenience in use. Therefore, in the case where the arrangement of furniture in a room is changed, for example, inconvenience may occur in using the locker which has been displaced in the room.

SUMMARY OF THE INVENTION

An object of the present invention is to make it possible to change the opening direction of a door to either right or left side as desired.

In order to attain the above object, the present invention has the following construction, namely, at both sides of the upper and lower parts of a door, an L-shaped hinge having a projecting lock bolt is provided on the frame, a locking device is provided on the door side opposite to the hinge in such a fashion that it fits in and separates from the lock bolt of the hinge in accordance with opening and closing action of the door, and a connecting rod is connected between right and left locking devices to fix the lock bolt fitted in the locking device on the side opposite to the opening direction, whereby the door is made openable either from the left or right side as desired.

BRIEF DESCRIPTION OF THE DRAWINGS

The nature and advantage of the present invention will be understood more clearly from the following description made with reference to the accompanying drawings, in which:

FIGS. 1–5*c* show a first embodiment of the door openable from the right or left side according to the present invention, in which:

FIG. 1 is a sectional plan view of the hinge part of the door according to the present invention;

FIG. 2 is a sectional front view of the hinge part shown in FIG. 1;

FIG. 3 is a perspective view of the hinge;

FIG. 4 is a perspective view of a locking device;

FIG. 5*c* is a view of the parts of FIG. 2*a* spaced apart as in FIG. 5*a;*

FIGS. 6–11 show a second embodiment of the door openable from the right or left side according to the present invention, in which:

FIG. 6 is a longitudinal section of a main part;

FIG. 7 is a front view of the locking device;

FIG. 8 is a side view of the locking device shown in FIG. 6;

FIG. 9 is a front view of a lock pin;

FIG. 10 is an elevation view of a stop plate; and

FIG. 11 is an explanatory drawing of a connecting rod;

FIGS. 12 and 13 show a third embodiment of the door opening from the right or left side according to the present invention, in which FIG. 12 is a longitudinal section of the hinge fitted in the door and FIG. 13 is a front view of the hinge.

DETAILED DESCRIPTION OF THE INVENTION

Figure 1:
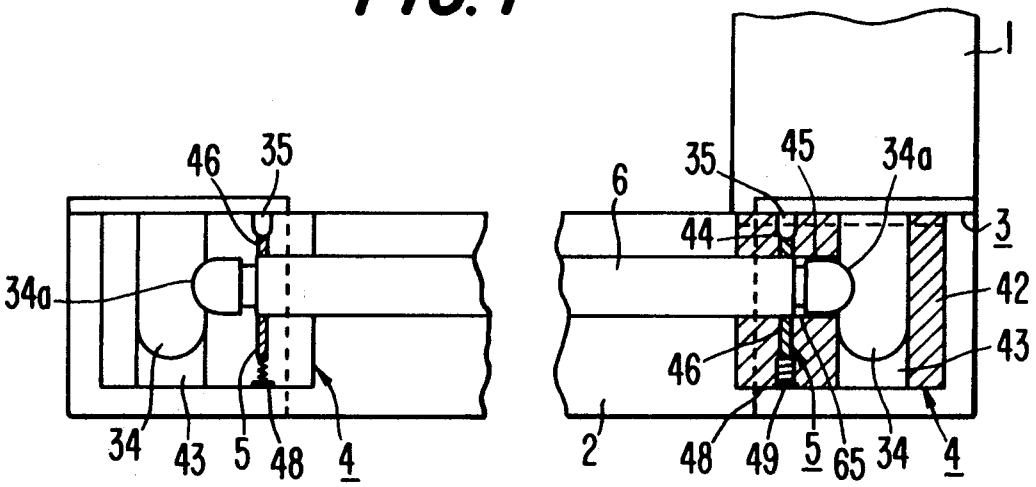

A description is given below of the door openable from the right or left side according to the present invention, on the basis of the embodiments shown in the drawings.

Figure 2:
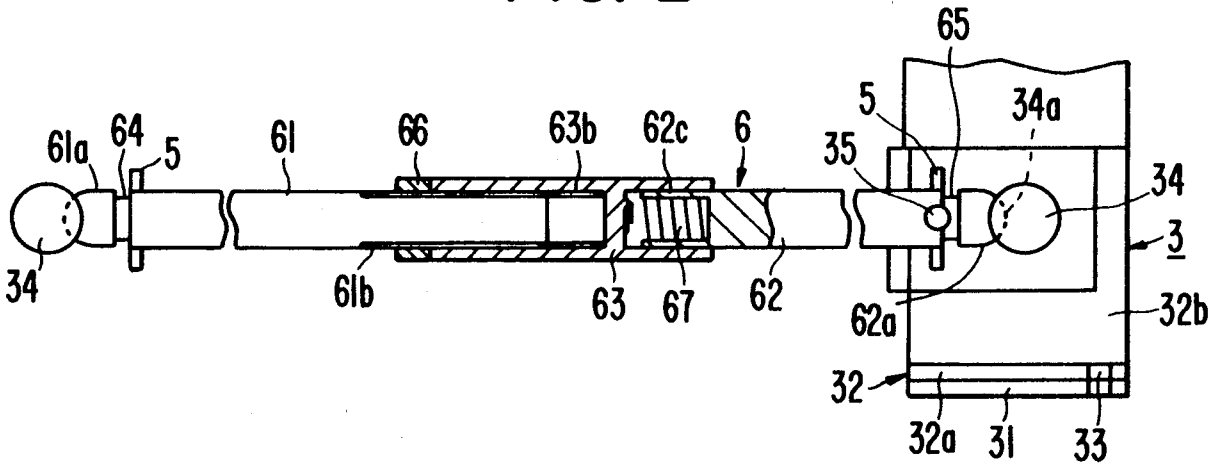
Figure 3:
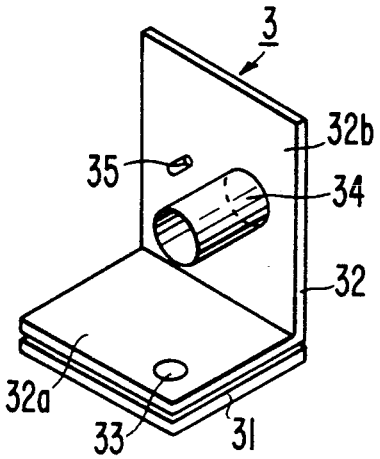

FIGS. 1–5*c* show the first embodiment. In the drawings, reference numeral 2 designates a main body of the door of a refrigerator, safe, locker or the like 1 (hereinafter referred to as a safe). A hinge 3 by which the door openable from the right or left side is made possible is provided at both sides of the upper and lower parts of the main body of the door 2. As shown in FIG. 3, the hinge 3 comprises a mounting plate 31 (flat plate) to be fixed to the upper and lower parts of the door frame of the safe 1 by screws 31*a* (FIG. 5*b*) and an L-shaped hinge main body 32 which is rotatable around a shaft 33 as the center on the mounting plate 31. At least one shaft hole is made in the mounting plate 31 and a lower piece 32*a* of the hinge main body 32 is secured to the mounting plate 31 by the shaft 33. At the inside of an upper (perpendicular) piece 32*b* of the hinge main body 32, a protruding lock bolt 34 and a projection 35 for pressing a stop plate 5, described later, are provided.

Figure 4:
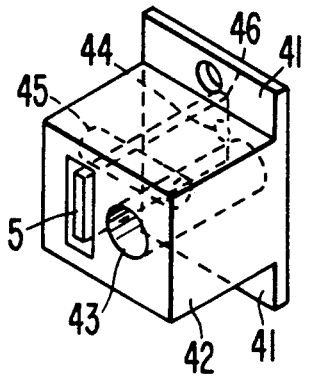
Figure 6:
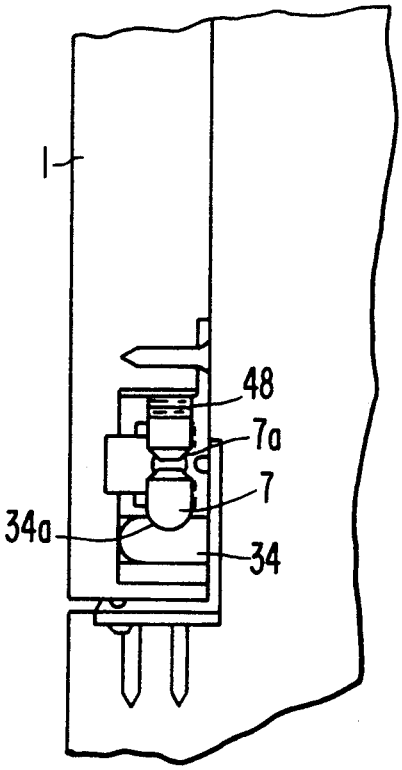
Figure 7:
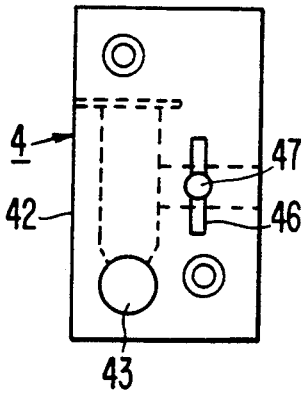
Figure 8:
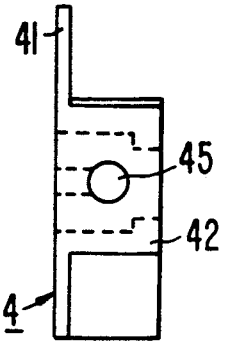
Figure 9:
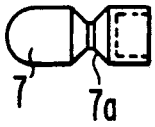
Figure 10:
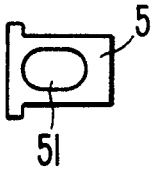
Figure 11:
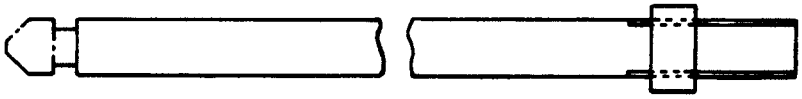

A locking device 4 shown in FIG. 4 is fixed to the door 2 opposite to the hinge 3 by flanges 41 and screws (not shown). The locking device 4 has the following construction.

The body 42 of the locking device 4 has a stop plate 5 therein and a lock bolt receiving hole 43 in which the lock bolt 34 of the hinge 3 is received and a projection receiving hole 44 in which the projection 35 is received, when the door 2 is closed or the hinge main body 32 is pivoting with the door, as described hereinafter. A connecting rod inserting hole 45 extends in a direction to intersect the lock bolt receiving hole 43.

Figure 2A:
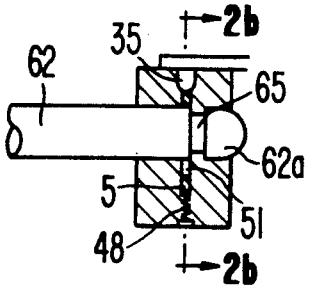
FIG. 2*a* is a sectional view of a detail of the structure of FIG. 2.
Figure 2B:
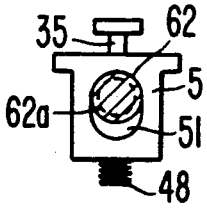
FIG. 2*b* is a section of line 2*b*–2*b* of FIG. 2*a;*

The stop plate 5, as shown in FIG. 2*b*, is flat and has an elongated slit 51 having a minor axis big enough to be able to pass a connecting rod 6, described later, therethrough and a major axis larger than the diameter of the connecting rod 6. In order to enable the stop plate 5 to move (slide) in the longitudinal direction of the slit 51, the stop plate is slidably mounted in a groove 46 of slit-like shape provided in the body 42 in a direction intersecting the connecting rod inserting hole 45. A hole 44 in which the projection 35 of the hinge is insertible is provided at one end (the flange 41 side) of the groove 46 and the other end of the groove 46 opens to the outside surface of the body 42. The stop plate 5 is inserted in the body 42 from the outside surface opening, a spring 48 for urging the stop plate 5 toward hole 44 is inserted and a lid 49 is put over the spring. Thus, the stop plate 5 is urged toward the flange 41 side of the body 42 by pressure of the spring 48.

With the above arrangement, when the door 1 with the hinge 3 on the main body 2 and the locking device 4 on the door opposite to the hinge is shut, the lock bolt 34 is fitted in the lock bolt hole 43 as shown in FIG. 1.

The pin 35 keeps stop plate 5 urged toward the bottom, as shown in FIGS. 1, 2*a* and 2*b*. A pair of hinges 3 and locking devices 4 is provided at the upper and lower parts of the door main body and at both the right and left sides. The hinges and locking devices at the right and left side are on the same level and the hinges and locking devices at the upper and lower parts are on the same vertical line.

The connecting rod 6 is positioned between opposite (right and left) locking devices in the main body 2. The connecting rod 6 is slidably mounted within the main body so that it cannot be seen from outside or inside. The connecting rod 6 is divided into two parts, a left connecting rod part 61 and a right connecting rod part 62, which are connected to each other by a connecting case 63. As shown in the drawing, the outer ends 61*a* and 62*a* of both rods 61 and 62 are hemispherical or conical and grooves 64 and 65 in which the stop plate 5 can engage are formed adjacent to outer ends of both rods 61 and 62. A male screw thread 61*b* is provided at a base end of the left connecting rod 61 and a corresponding female screw thread 63*b* is provided in the rod receiving recess in connecting case 63, whereby the length of the connecting rod 6 (when the left connecting rod 61 and the right connecting rod 62 are connected by the connecting case 63) can be adjusted. A lock nut 66 can be used for avoiding loosening of the connection between the left connecting rod 61 and the connecting case 63. A cavity 62*c* is formed at the base end of the right connecting rod 62 and a spring 67 is interposed between the cavity 62*c* and the inner end of the rod receiving recess of the connecting case 63. By the repulsive force of the spring 67, the connecting rods 61 and 62 are urged away from each other, for making the total length of the connecting rod 6 longer. As shown in FIG. 2, in the state where the door 1 is shut, by the action of the spring 67, the outer ends 61*a* and 62*a* of the left and right connecting rods 61 and 62 are urged into cavities 34*a* of the respective lock bolts 34 and the connecting rods extend through the openings 51 in stop plates 5 so that the grooves 64 and 65 are past the stop plates.

Figure 5A:
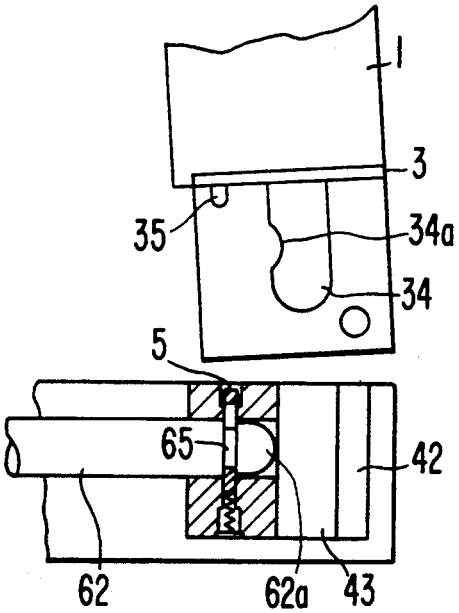
FIG. 5*a* is a view of the right hand end of the structure of FIG. 1 with the door open.
Figure 5C:
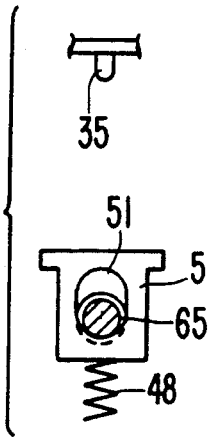
Figure 5B:
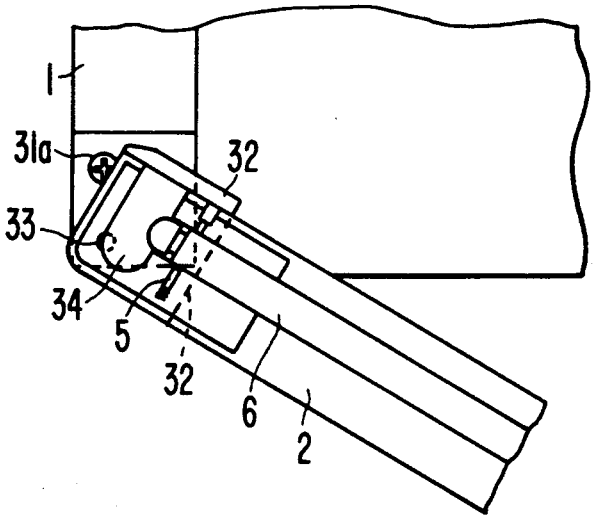
FIG. 5*b* is a view of the left hand end of the structure of FIG. 1 with the door open.

In the above device, if a knob on either the left or right side of the door is pulled toward the user, i.e. downward in FIG. 1, the hinge 3 and the locking device 4 on the side pulled (for example, on the right side of the door) are disengaged by the body 4 with the lock bolt 34 slipping off the lock bolt 34 on the upper piece 32*b* of the hinge main body 32, as shown in FIG. 5*a*, but the hinge and the locking device on the opposite (left) side of the door rotates around the shaft 33 between the mounting plate 31 and the hinge main body 32 as the center, while the lock bolt 34 is kept fitted in the lock bolt hole 43, as shown in FIG. 5*b*. At this time, since the axes 33 of the hinges 3 provided at the upper and lower end portions on the left side of the door body are on the same vertical line, the door rotates in the opening direction around the axis 33 as the center. In the case of opening the door by pulling at the left side at the hinge 3 and the locking device 4 on the right side of the door, the lock bolt 34 is retained in the lock bolt hole 43, but on the left side of the door the body 42 with the lock bolt hole 4 slips off the lock bolt 34.

At this time, the right hand side of the door is pulled to open it as in FIG. 5*a*, the outer end 62*a* of the right connecting rod 62 is caused to slip out of the cavity 34*a* in the lock bolt 34 by the force of the body 42 moving along the lock bolt 34, and moves to the outer circumferential surface of the outer end of the lock bolt, whereupon the right connecting rod 62 is pushed to the left side by an amount equal to the depth of the cavity 34*a*. This pushing to the left is absorbed by the spring 67, and the spring urges the left connecting rod 61 to the left so that the outer end 61*a* is securely fitted in the cavity 34*c* of the lock bolt 34 on the left hinge. When the right connecting rod 62 is pushed to the left, the edge of the plate at the slit 51 of the stop plate 5, which has been freed to move upwardly in FIG. 5*a* by a movement away from pin 35, is urged into the groove 65 in the right connecting rod 62 by spring 48, whereby the connecting rod 6 is locked in a retracted position and movement toward lock bolt hole 43 is blocked. Therefore, even if the user were then to try to open the left side of the door by pulling on a knob on the left side, the locking device 4 on the left side would not slip off the hinge, and thus at the time of opening of the door from the right side, the hinge on the left side would come out safe and accurate opening and closing action. In the case of opening from the left side, the operation is the reverse of the above description operation.

When the door is shut, the lock bolt hole 43 moves back over lock bolt 34, pin 35 engages stop plate 5 to move it down in FIGS. 5*a* and 5*c* to the FIG. 2*a*, FIG. 2*b* position, whereby spring 67 moves the connecting rod to the right in FIGS. 1 and 2 to engage the outer end in the cavity 34*c* of the lock bolt.

FIGS. 6–11 show the second embodiment. The hinge 3 in this embodiment is the same as that in the first embodiment except the locking device 4 in this embodiment is somewhat different. A lock pin 7 having a groove 7*a* in the central outer circumference thereof is slidably fitted under the force of the spring 48 in the locking device 4. It is so designed that the outer end of the lock pin 7 is fitted in the cavity 34*a* of the lock bolt 34 when the locking device and the hinge are engaged with each other when the door is closed. A slit 51 in which the lock pin 7 is fitted is formed at the stop plate 5.

The connecting rod 6 in the second embodiment is also divided into two (left and right connecting rods) and the total length of the connecting rod 6 is adjustable by means of a spring. The lateral movement of the connecting rod 6 is effected by utilizing the spring force of the spring 48 and the force generated when the lock bolt moves.

Figure 12:
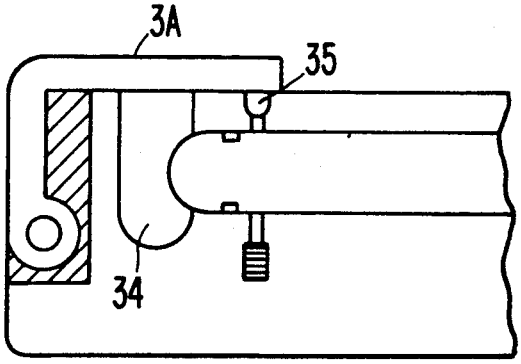
Figure 13:
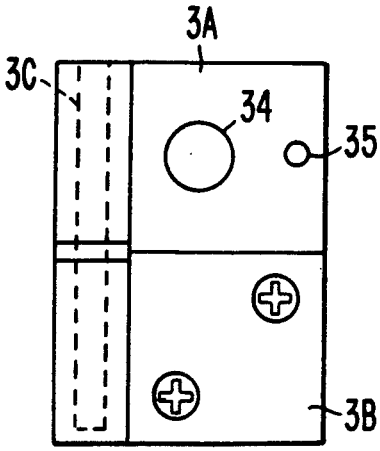

FIGS. 12 and 13 show the third embodiment. In this embodiment, the shape of hinge 3 is changed. An upper hinge piece 3A and a lower hinge piece 3B, each having a shaft fitting part at an end thereof, are positioned one above the other and one shaft 3C extends therethrough. Screw holes are made in the lower hinge piece 3B for mounting it on the frame, and the lock bolt 34 and the projection 35 are provided on the upper hinge piece 3A. By this construction, the hinge 3 can be fitted at the desired position on the door.

According to the present invention, at the upper and lower parts on both sides of the door, an L-shaped hinge having a projecting lock bolt is provided on the frame, a locking device is provided on the door opposite to the hinge such that it fits over and separates from the lock bolt of the hinge in accordance with the opening and closing action of the door, and a connecting rod is provided between right and left locking devices to fix the lock bolt fitted in the locking device on the side other than the side from which the door is opened, whereby the door can be opened from either the left or right side as desired.

What is claimed is:

1. A door structure openable from the right side or the left side, comprising:

door frame means for supporting a door;

a door main body fittable with said door frame means for closing said door frame means;

hinge means at an upper and lower position on both sides of said door main body and door frame means for permitting said door main body to be opened from either the right or the left sides, said hinge means each having a shaft carrying member mounted on the door main frame and an L-shape hinge member having one leg pivotally mounted on said shaft carrying member for pivoting movement about an axis of opening movement of said door main body along a side thereof, and the other leg having a locking bolt projecting therefrom in a direction in which said door main body moves away from said door frame means during opening movement of said door main body, said locking bolt having a recess opening laterally of the length thereof, said hinge means further having a locking body on said door main body having a locking bolt receiving recess therein in which said locking bolt is received when said door main body is closed against said door frame means, a locking pin in said locking body movable laterally of said locking body and into said locking bolt receiving recess and having an outer end engagable in said laterally open recess in said locking bolt for normally retaining said locking bolt in said locking bolt receiving recess and spring means engaged with said locking pin for urging said locking pin toward said locking bolt receiving recess, said outer end and laterally open recess having a shape for permitting said locking bolt and said locking body to be separated by a force urging said locking body lengthwise along said locking bolt, whereby when an opening force is exerted on one side of said door main body, said locking bodies of the hinge means at said one side of said door main body are separated from said locking bolts by the outer ends of said locking pins being forced out of said laterally open recesses to force said locking pins back into said locking bodies against the action of the spring means and thereby permit said one side of said door main body to move away from said door frame means, and the outer ends of the locking pins on the hinge means at the other side of said door main body remain engaged in said laterally open recesses for causing said L-shape hinge member to remain engaged with said door main body and to pivot on said shaft carrying members of said hinge means to permit said door main body to pivot about said other side.

2. A door structure as claimed in claim 1 further comprising a connecting rod extending between said locking pins in said hinge means on opposite sides of said door main body and to which said locking pins are connected, said spring means being connected between said connecting rod and one of said locking pins, whereby when one of said locking pins on one side of said door main body is urged out of the laterally open recess of the corresponding locking bolt, said spring means is compressed further from the condition when said locking pin is engaged in said laterally open recess, and a further force from said further compression is exerted on the locking pin at the other end of said connecting rod.

3. A door structure as claimed in claim 1 in which each of said locking pins has a groove therearound spaced from said one end, and said structure further comprises a stop plate slidably mounted in said locking body for movement laterally of said locking pin and parallel to said locking bolt, said stop plate having an elongated aperture therein elongated in the direction of lateral movement and a size for permitting said locking pin to pass therethrough, and further spring means urging said stop plate toward said other leg of said L-shape hinge member, and said other leg of said L-shape hinge member having a pin thereon extending into said locking body when said locking body is against said other leg of said L-shape hinge member for blocking movement of said stop plate in a position where said locking pin is free to move through said stop plate, whereby when said door main body is moved away from said door frame means, said locking body is moved away from said pin, freeing said stop plate to move, and said groove being spaced from said one end of said locking pin a distance for causing said groove to be aligned with said stop plate when said locking pin is disengaged from said laterally open recess in said locking bolt, whereby when said door main body is moved away from said door frame means and said locking pin is moved out of engagement with said laterally open recess, said stop plate is moved into said groove for blocking movement of said locking pin toward said locking pin receiving recess.

* * * * *